US011141773B1

(12) United States Patent
Gu et al.

(10) Patent No.: US 11,141,773 B1
(45) Date of Patent: Oct. 12, 2021

(54) DEVICE AND METHOD FOR STRENGTHENING THIN-WALLED STRAIGHT PIPE

(71) Applicant: YANSHAN UNIVERSITY, Hebei (CN)

(72) Inventors: Yongfei Gu, Hebei (CN); Junting Luo, Hebei (CN); Weipeng Liu, Hebei (CN); Lili Zhang, Hebei (CN); Chunxiang Zhang, Hebei (CN)

(73) Assignee: YANSHAN UNIVERSITY, Qinghuangdao (CN)

( * ) Notice: Subject to any disclaimer, the term of this patent is extended or adjusted under 35 U.S.C. 154(b) by 0 days.

(21) Appl. No.: 17/205,582

(22) Filed: Mar. 18, 2021

(30) Foreign Application Priority Data

Mar. 24, 2020 (CN) ..... 202010212224.4

(51) Int. Cl.
*B21D 26/047* (2011.01)
*B21D 3/14* (2006.01)

(52) U.S. Cl.
CPC ..... *B21D 26/047* (2013.01); *B21D 3/14* (2013.01)

(58) Field of Classification Search
CPC .. B21D 26/033; B21D 26/035; B21D 26/037; B21D 26/039; B21D 26/041; B21D 26/043; B21D 26/045; B21D 26/047; B21D 26/051; B21D 3/14
USPC ..... 72/62
See application file for complete search history.

(56) References Cited

U.S. PATENT DOCUMENTS 5,445,001 A * 8/1995 Snavely ..... B21D 26/033 72/55
8,091,200 B2 * 1/2012 Kobayashi ..... B21D 26/045 72/58
9,821,365 B2 * 11/2017 Colosseo ..... B21D 26/033

FOREIGN PATENT DOCUMENTS

| | | | |
|---|---|---|---|
| CN | 105921588 | A | 9/2016 |
| CN | 106216479 | A | 12/2016 |
| CN | 106424261 | A | 2/2017 |
| CN | 108555108 | A | 9/2018 |
| CN | 109622698 | A | 4/2019 |
| CN | 109719186 | A | 5/2019 |
| CN | 110523833 | A | 12/2019 |
| JP | 2006255750 | A | 9/2006 |

* cited by examiner

*Primary Examiner* — Teresa M Ekiert

(57) ABSTRACT

A device for strengthening a straight pipe, including a first positioning mold, a second positioning mold, a split mold, a rounding mold, a first cavity and a second cavity. A method for strengthening a straight pipe is further provided. The split mold is adjusted to position the pipe. The pipe is inserted into the first and second positioning molds. First and second sealing rings are arranged in an inner cavity of the pipe. Hydraulic oil is injected into the first cavity to expand the pipe to perform an expanding deformation. When the hydraulic oil is unloaded, the split mold moves towards an axis of the first positioning mold to perform a reducing deformation. After the expanding and reducing deformations, the pipe is transported into the rounding mold, and hydraulic oil is injected into the second cavity to expand the pipe to perform the rounding.

8 Claims, 5 Drawing Sheets

DEVICE AND METHOD FOR STRENGTHENING THIN-WALLED STRAIGHT PIPE

CROSS-REFERENCE TO RELATED APPLICATIONS

This application claims the benefit of priority from Chinese Patent Application No. 202010212224.4, filed on Mar. 24, 2020. The content of the aforementioned application, including any intervening amendments thereto, is incorporated herein by reference in its entirety.

TECHNICAL FIELD

This application relates to pipe-processing equipment and supporting facilities thereof, and more particularly to a device and a method for strengthening a thin-walled straight pipe.

BACKGROUND

Due to the advantages of various size specifications, simple preparation and light weight, thin-walled straight pipes have been widely used in the modern industrial pipelines. However, the existing thin-walled straight pipes are less preferable in strength, and cannot withstand high internal or external pressure. Generally, it is feasible to thicken the pipe wall to enhance the strength. Nevertheless, this strengthening process will bring higher consumption of materials and larger weight of the pipe.

Therefore, how to enhance the strength of the thin-walled straight pipe without thickening the pipe wall has become a problem to be solved by those skilled in the art.

SUMMARY

An object of this application is to provide a device for strengthening a thin-walled straight pipe to improve strength of the straight pipe without increasing its thickness.

The technical solutions of the disclosure are described as follows.

In a first aspect, this application provides a device for strengthening a straight pipe, comprising:

a first positioning mold;

a second positioning mold;

at least two split molds;

a rounding mold; and a sealing assembly;

wherein the first positioning mold and the second positioning mold are coaxially arranged and are respectively provided with a first through hole and a second through hole configured to allow a pipe to pass through; the at least two split molds are slidably arranged between the first positioning mold and the second positioning mold; a motion direction of the at least two split molds with respect to the first positioning mold and the second positioning mold is perpendicular to an axis of the first positioning mold; adjacent split molds of the at least two split molds abut against each other to form a ring; a side of each of the at least two split molds facing the axis of the first positioning mold is provided with a protrusion; a minimum inner diameter of the ring formed by the at least two split molds is smaller than an inner diameter of the first positioning mold; the rounding mold is arranged downstream of the at least two split molds along a transportation direction of the pipe, and abuts against the second positioning mold; the rounding mold is provided with a third through hole configured to allow the pipe to pass through; an inner diameter of the rounding mold matches with an outer diameter of the pipe; the sealing assembly comprises a first sealing ring, a second sealing ring and a third sealing ring; the first sealing ring, the second sealing ring and the third sealing ring are able to enter an inner cavity of the pipe; the first sealing ring and the second sealing ring form a first cavity with an inner wall of the pipe; the second sealing ring and the third sealing ring form a second cavity with the inner wall of the pipe; and the first cavity and the second cavity are respectively communicated with an external environment.

In some embodiments, the protrusion has a curved surface.

In some embodiments, the at least two split molds are connected to a push rod; an axis of the push rod is perpendicular to the axis of the first positioning mold, and intersects the axis of the first positioning mold; the push rod is connected to a hydraulic cylinder; and the hydraulic cylinder is configured to drive the push rod to reciprocate.

In some embodiments, the number of the at least two split molds is six, and the six split molds are evenly arranged in a circumferential direction.

In some embodiments, the first positioning mold, the second positioning mold and the rounding mold all have a split-type structure; the first positioning mold comprises a first positioning upper mold and a first positioning lower mold abutting against each other; the second positioning mold comprises a second positioning upper mold and a second positioning lower mold abutting against each other; and the rounding mold comprises an upper rounding mold and a lower rounding mold abutting against each other.

In some embodiments, the first sealing ring is connected to a first oil delivery pipe; the first oil delivery pipe is communicated with the first cavity; the third sealing ring is connected to a second oil delivery pipe; the second oil delivery pipe is communicated with the second cavity; the second sealing ring is connected to at least one connecting rod; and the at least one connecting rod passes through the third sealing ring and extends out of the second cavity.

In some embodiments, the first sealing ring, the second sealing ring, the first oil delivery pipe and the second oil delivery pipe are coaxially arranged; the number of the at least one connecting rod is two, and the two connecting rods are provided symmetrically on both sides of the second oil delivery pipe; the first oil delivery pipe is in threaded connection with the first sealing ring; the second oil delivery pipe is in threaded connection with the third sealing ring; and the two connecting rods are in threaded connection with the second sealing ring.

In a second aspect, the disclosure further provides a method for strengthening a straight pipe using the above device, comprising:

adjusting the at least two split molds to position a pipe such that a gap is provided between an inner wall of each of the at least two split molds and the pipe;

inserting the pipe into the first through hole and the second through hole;

arranging the first sealing ring and the second sealing ring in the inner cavity of the pipe;

injecting hydraulic oil into the first cavity to press the inner wall of the pipe to expand the pipe, so as to perform an expanding deformation;

unloading the hydraulic oil in the pipe;

moving the at least two split molds towards the axis of the first positioning mold until adjacent two split molds abut against each other, so as to perform a reducing deformation;

repeating the expanding deformation and the reducing deformation multiple times;

transporting the pipe forwards into the third through hole; and injecting hydraulic oil to the second cavity to press the inner wall of the pipe to expand the pipe to perform a rounding operation.

In some embodiments, the pipe is positioned such that a minimum gap between the at least two split molds and the pipe is 5 mm; a pressure of the hydraulic oil injected into the first cavity is 6.5 MPa; an expansion height of the pipe is 5 mm; during the reducing deformation, a feed distance of the at least two split molds towards the axis of the first positioning mold is 5 mm; and a pressure of the hydraulic oil injected into the second cavity is 6 MPa.

In some embodiments, after the expanding deformation and the reducing deformation are performed five times, the pipe is transported to the rounding mold for rounding.

The beneficial effects of the present disclosure are described as follows.

This disclosure provides a device for strengthening a straight pipe, and the device includes a first positioning mold, a second positioning mold, at least two split molds, a rounding mold and a sealing assembly. The first positioning mold and the second positioning mold are coaxially arranged and are respectively provided with a first through hole and the second through hole configured to allow a pipe to pass through. The at least two split molds are slidably arranged between the first positioning mold and the second positioning mold. A motion direction of the at least two split molds with respect to the first positioning mold and the second positioning mold is perpendicular to an axis of the first positioning mold. Adjacent split molds of the at least two split molds abut against each other to form a ring. A side of each of the two split molds facing the axis of the first positioning mold is provided with a protrusion. A minimum inner diameter of the ring formed by the at least two split molds is smaller than an inner diameter of the first positioning mold. The rounding mold is arranged downstream of the at least two split molds along a transportation direction of the pipe, and abuts against the second positioning mold. The rounding mold is provided with a third through hole configured to allow the pipe to pass through. An inner diameter of the rounding mold matches with an outer diameter of the pipe. The sealing assembly includes a first sealing ring, a second sealing ring and a third sealing ring. The first sealing ring, the second sealing ring and the third sealing ring can enter an inner cavity of the pipe. The first sealing ring and the second sealing ring form a first cavity with an inner wall of the pipe. The second sealing ring and the third sealing ring form a second cavity 13 with the inner wall of the pipe. The first cavity and the second cavity are respectively communicated with an external environment. The present disclosure further provides a method for strengthening a straight pipe. The at least two split molds are adjusted to position the pipe, such that a gap is provided between an inner wall of the split molds and the pipe. The pipe is inserted into the first through hole and the second through hole. The first sealing ring and the second sealing ring are arranged in the inner cavity of the pipe. Hydraulic oil is injected into the first cavity to press the inner wall of the pipe to expand the pipe, so as to perform an expanding deformation. When the hydraulic oil in the pipe is unloaded, the at least two split molds move towards the axis of the first positioning mold the axis of the first positioning mold until adjacent two split molds abut against each other, so as to perform a reducing deformation. After multiple cycles of expanding and reducing deformations, the pipe is transported forwards into the third through hole of the rounding mold, and hydraulic oil is injected into the second cavity to press the inner wall of the pipe to expand the pipe to perform a rounding operation. Through multiple times of plastic deformation of a pipe wall, the residual stress and residual strain are accumulated in a material of the pipe, so as to strengthen the pipe. With the help of rounding mold and an internal pressure, a nominal diameter of the thin-walled straight pipe is kept unchanged. Meanwhile, the rigidity, strength, hardness and pressure-resistant ability of the thin-walled straight pipe are improved, promoting the use of the thin-walled straight pipe in the lightweight and high-strength engineering.

BRIEF DESCRIPTION OF THE DRAWINGS

The technical solutions of the prior art and the present disclosure will be further described clearly with reference to the accompanying drawings. Obviously, presented in the accompanying drawings are merely some embodiments of this disclosure, and are not intended to limit the disclosure. Other drawings obtained by those skilled in the art without sparing any creative effort should fall within the scope of the disclosure.

Figure 1:
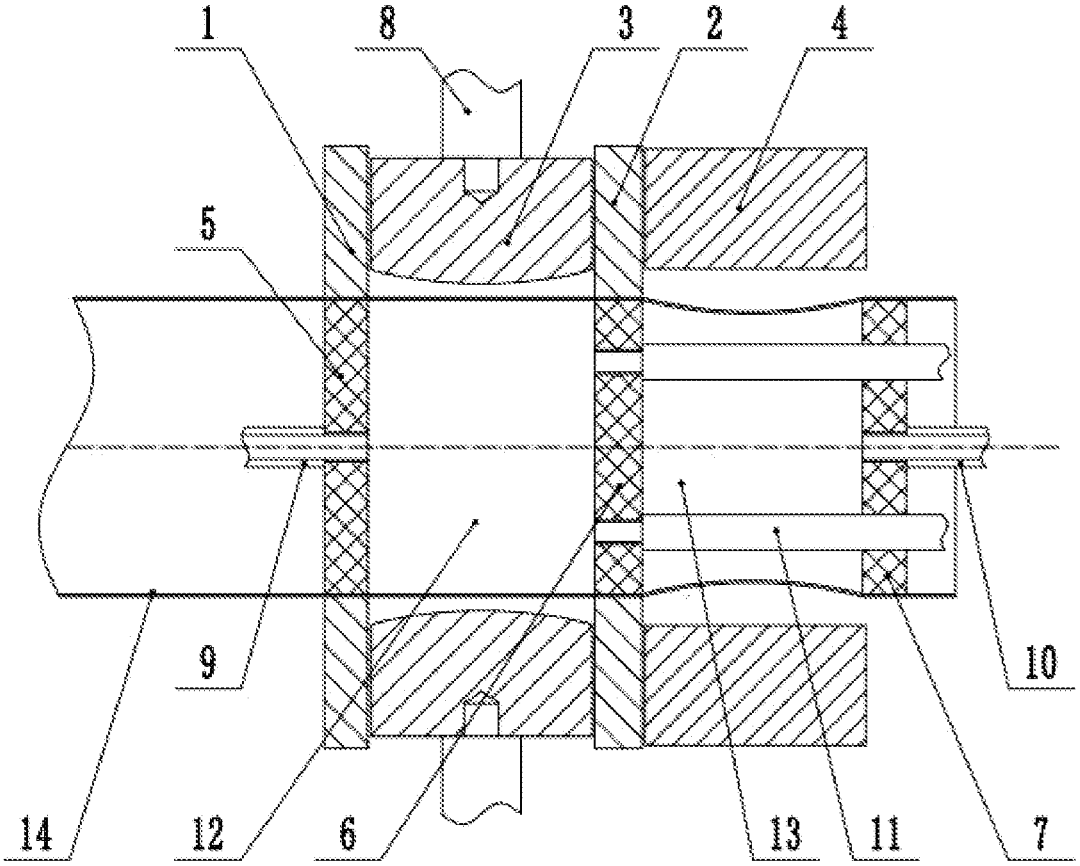
FIG. 1 is a front view showing a sectional structure of a device for strengthening a straight pipe in a positioning stage according to an embodiment of the present disclosure.

in the drawings, 1, first positioning mold; 101, first positioning upper mold; 102, first positioning lower mold; 2, second positioning mold; 201, second positioning upper mold; 202, second positioning lower mold; 3, split mold; 4, rounding mold; 401, upper round mold; 402, lower rounding mold; 5, first sealing ring; 6, second sealing ring; 7, third sealing ring; 8, push rod; 9, first oil pipe; 10, second oil pipe; 11, connecting pipe; 12, first cavity; 13, second cavity; and 14, pipe;

$L_1$ is a height of the split mold; $L_2$ is a height of the rounding mold; h is an expansion height and a reducing depth; and D is a diameter of the pipe.

DETAILED DESCRIPTION OF EMBODIMENTS

The technical solutions of the present disclosure are described clearly with reference to the accompanying drawings and embodiments. Obviously, presented below are merely some embodiments of this disclosure, and are not intended to limit this disclosure. It should be understood that other embodiments made by those skilled in the art based on the content disclosed herein without sparing any creative effort should fall within the scope of the disclosure defined by the appended claims.

An object of the present disclosure is to provide a device for strengthening a straight pipe, so as to improve strength of the straight pipe without increasing a thickness of the straight pipe.

The disclosure will be described in detail below with reference to the accompanying drawings and embodiments to make the objects, technical solutions and beneficial effects of the present disclosure clearer.

Figure 2:
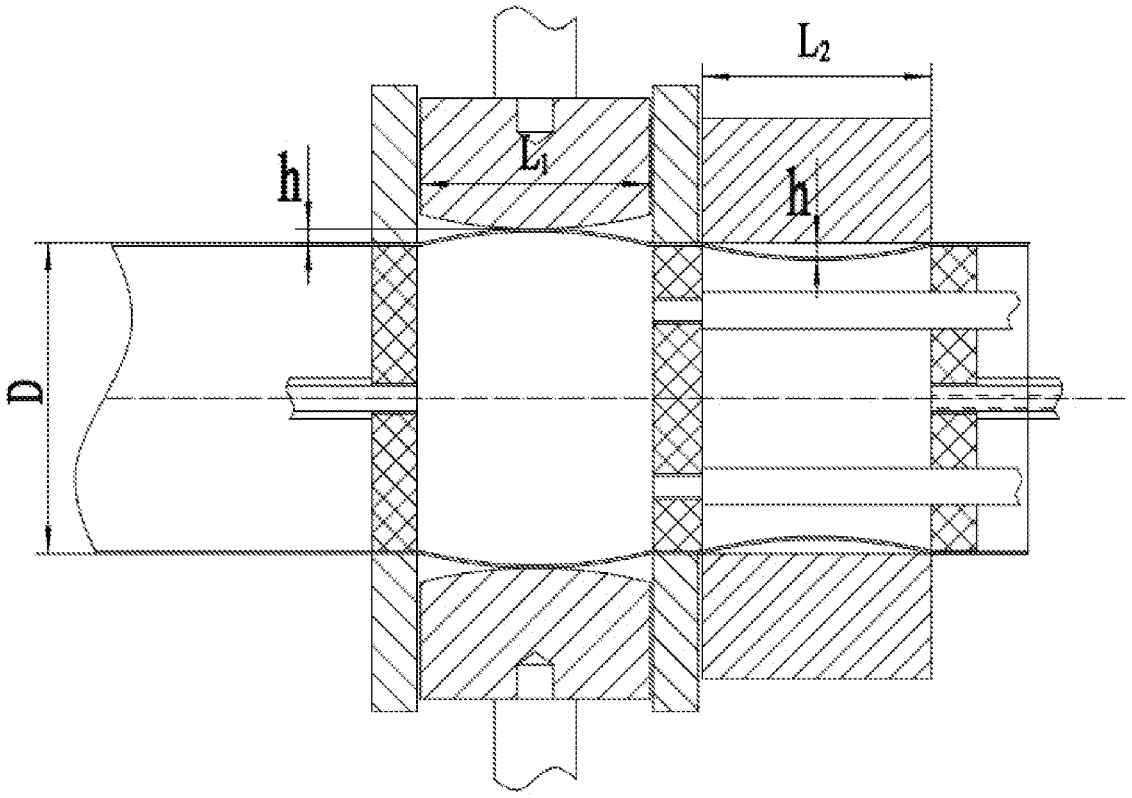
FIG. 2 is a front view showing the sectional structure of the device for strengthening a straight pipe in an expanding stage according to an embodiment of the present disclosure.
Figure 3:
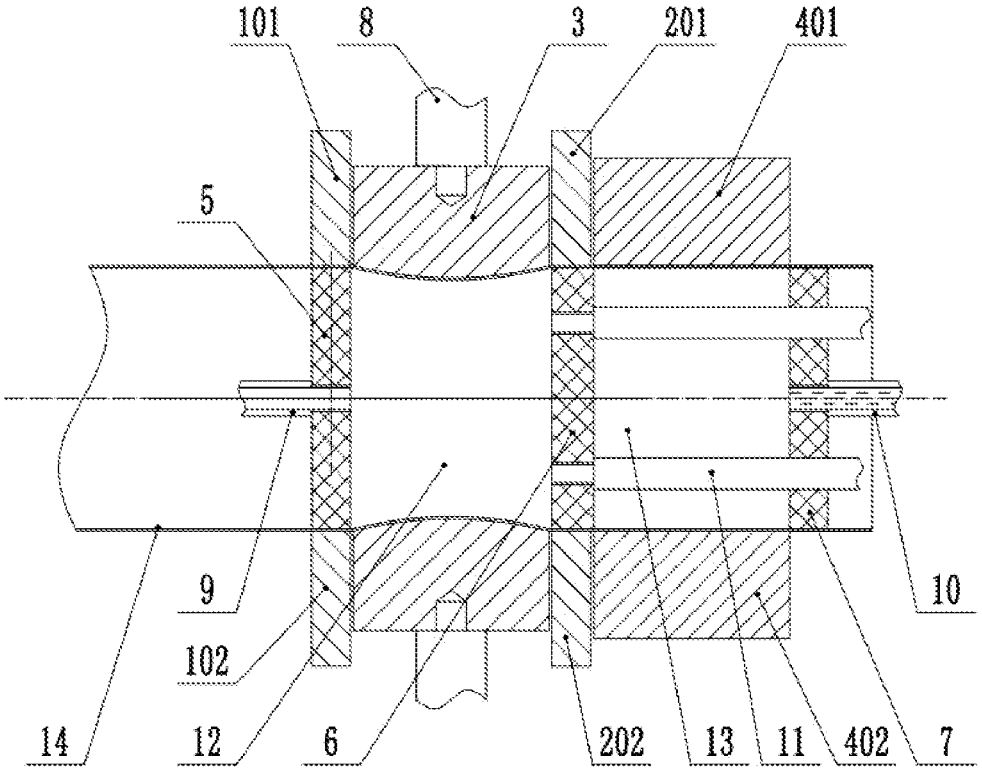
FIG. 3 is a front view showing the sectional structure of the device for strengthening a straight pipe in a reducing stage according to an embodiment of the present disclosure.
Figure 4:
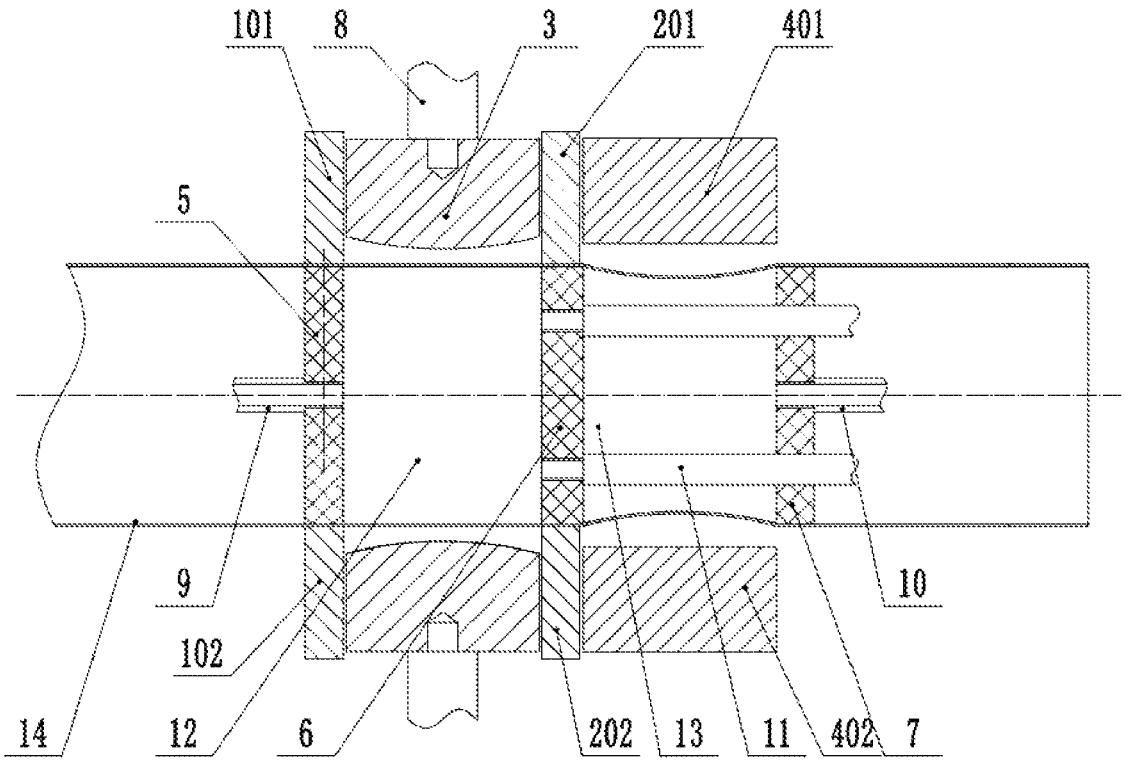
FIG. 4 is a front view showing the sectional structure of the device for strengthening a straight pipe in a feeding stage according to an embodiment of the present disclosure.
Figure 5:
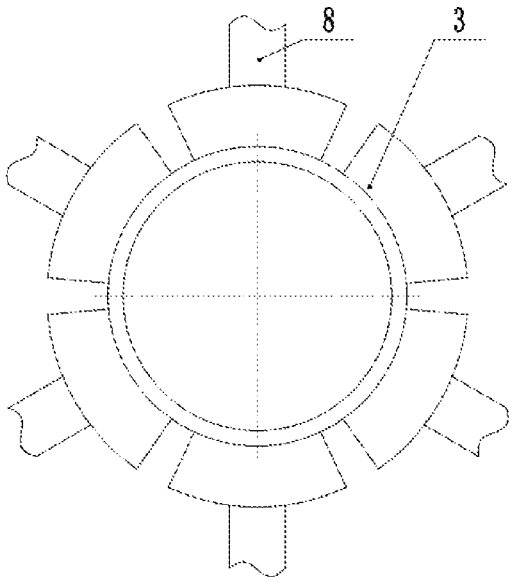
FIG. 5 is a left view showing the sectional structure of the device for strengthening a straight pipe in an expanding stage according to an embodiment of the present disclosure.
Figure 6:
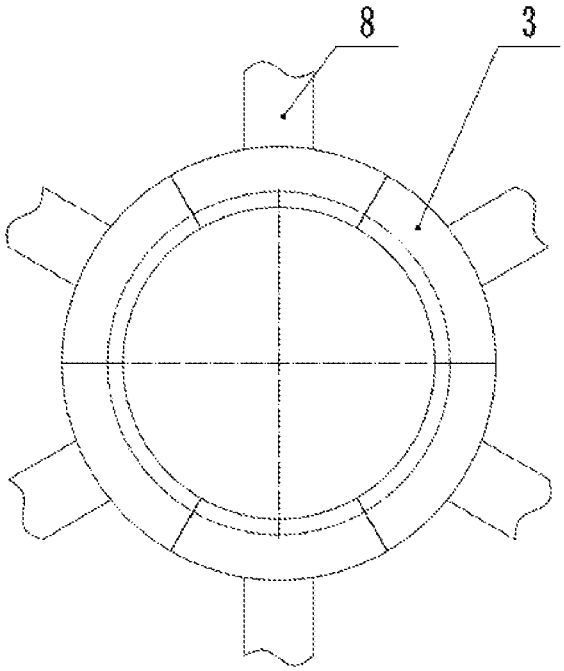
FIG. 6 is a left view showing the sectional structure of the device for strengthening a straight pipe in a reducing stage according to an embodiment of the present disclosure.
Figure 7:
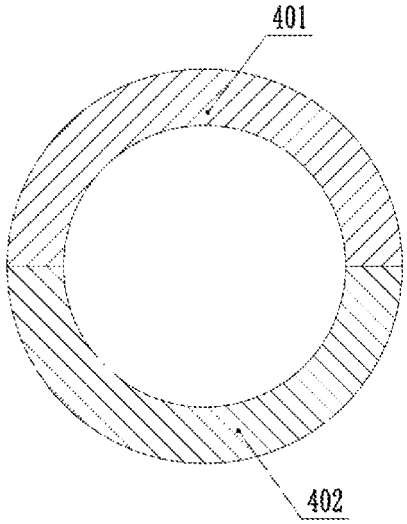
FIG. 7 is a left view showing the sectional structure of the device for strengthening a straight pipe in a rounding stage according to an embodiment of the present disclosure.

With regard to the drawings, FIG. 1 is a front view showing a sectional structure of a device for strengthening a straight pipe in a positioning stage according to an embodiment of the present disclosure. FIG. 2 is a front view showing the sectional structure of the device for strengthening a straight pipe in an expanding stage according to an embodiment of the present disclosure. FIG. 3 is a front view showing the sectional structure of the device for strengthening a straight pipe in a reducing stage according to an embodiment of the present disclosure. FIG. 4 is a front view showing the sectional structure of the device for strengthening a straight pipe in a feeding stage according to an embodiment of the present disclosure. FIG. 5 is a left view showing the sectional structure of the device for strengthening a straight pipe in an expanding stage according to an embodiment of the present disclosure. FIG. 6 is a left view showing the sectional structure of the device for strengthening a straight pipe in a reducing stage according to an embodiment of the present disclosure. FIG. 7 is a left view showing the sectional structure of the device for strengthening a straight pipe in the rounding stage according to an embodiment of the present disclosure.

This disclosure provides a device for strengthening a straight pipe, and the device includes a first positioning mold 1, a second positioning mold 2, at least two split molds 3, a rounding mold 4 and a sealing assembly. The first positioning mold 1 and the second positioning mold 2 are coaxially arranged and are respectively provided with a first through hole and the second through hole configured to allow a pipe 14 to pass through. The at least two split molds 3 are slidably arranged between the first positioning mold 1 and the second positioning mold 2. A motion direction of the at least two split molds 3 with respect to the first positioning mold 1 and the second positioning mold 2 is perpendicular to an axis of the first positioning mold 1. Adjacent split molds 3 of the at least two split molds abut against each other to form a ring. A side of each of the two split molds 3 facing the axis of the first positioning mold 1 is provided with a protrusion. A minimum inner diameter of the ring formed by the at least two split molds is smaller than an inner diameter of the first positioning mold 1. The rounding mold 4 is arranged downstream of the at least two split molds 3 along a transportation direction of the pipe 14, and abuts against the second positioning mold 2. The rounding mold 4 is provided with a third through hole configured to allow the pipe 14 to pass through. An inner diameter of the rounding mold 4 matches with an outer diameter of the pipe 14. The sealing assembly includes a first sealing ring 5, a second sealing ring 6 and a third sealing ring 7. The first sealing ring 5, the second sealing ring 6 and the third sealing ring 7 can enter an inner cavity of the pipe 14. The first sealing ring 5 and the second sealing ring 6 form a first cavity 12 with an inner wall of the pipe 14. The second sealing ring 6 and the third sealing ring 7 form a second cavity 13 with the inner wall of the pipe 14. The first cavity 12 and the second cavity 13 are respectively communicated with an external environment.

The pipe 14 is strengthened using the device for strengthening a straight pipe. The at least two split molds 3 are adjusted to position the pipe 14, such that a gap is provided between an inner wall of the split molds 3 and the pipe 14. The pipe 14 is inserted into the first through hole and the second through hole. The first sealing ring 5 and the second sealing ring 6 are arranged in the inner cavity of the pipe 14. Hydraulic oil is injected into the first cavity 12 to press the inner wall of the pipe 14 to expand the pipe 14, so as to perform an expanding deformation. When the hydraulic oil in the pipe 14 is unloaded, the at least two split molds 3 move towards the axis of the first positioning mold 1 the axis of the first positioning mold 1 until adjacent two split molds abut against each other, so as to perform a reducing deformation. After multiple cycles of expanding and reducing deformations, the pipe 14 is transported forwards into the third through hole of the rounding mold 4, and hydraulic oil is injected into the second cavity 13 to press the inner wall of the pipe 14 to expand the pipe 14 to perform a rounding operation. In the present disclosure, through multiple times of plastic deformation of a pipe wall, the residual stress and residual strain are accumulated in a material of the pipe 14, so as to strengthen the pipe 14. With the help of the rounding mold 4 and an internal pressure, a nominal diameter of the thin-walled straight pipe is kept unchanged. Meanwhile, the rigidity, strength, hardness and pressure-resistant ability of the thin-walled straight pipe are improved, promoting the use of the thin-walled straight pipe in the lightweight and high-strength engineering. In addition, the two-step deformation method used herein reduces the cost of mold design and processing as well as improves the processing efficiency.

The protrusion has a curved surface. When the protrusion presses the pipe 14 for reducing, the curved surface can prevent the protrusion from forming a blind angle on the pipe 14 and protect the pipe 14.

In some embodiments, the at least two split molds 3 are connected to a push rod 8. An axis of the push rod 8 is perpendicular to the axis of the first positioning mold 1, and intersects the axis of the first positioning mold 1. The push rod 8 is connected to a hydraulic cylinder, which can drive the push rod 8 to reciprocate. Driven by the hydraulic cylinder, the push rod 8 drives the split mold 3 to reciprocate in a radial direction of the first positioning mold 1. When positioning the pipe 14, the split mold 3 moves in a direction away from the axis of the first positioning mold 1 to limit the expanding of the pipe 14. During the reducing, the split mold 3 moves towards the axis of the first positioning mold 1 to exert a force on the pipe 14, so as to perform the reducing deformation of the pipe 14. In an embodiment, the number of the at least two split molds 3 is six, and the six split are evenly arranged in a circumferential direction, so as to improve a force uniformity of the pipe 14. The number of the push rods 8 and the number of the hydraulic cylinders are the same as that of the split molds 3. The push rods 8, the hydraulic cylinders and the split molds 3 are respectively corresponded. A first gap is arranged between the split molds 3 and the first positioning mold 1. A second gap is arranged between the split molds 3 and the second positioning mold 2. In an embodiment, a width of the first gap is 1-3 mm, and a width of the second gap is 1-3 mm.

In some embodiments, the first positioning mold 1, the second positioning mold 2 and the rounding mold 4 all have a split-type structure. The first positioning mold 1 includes a first positioning upper mold 101 and a first positioning lower mold 102 abutting against each other. The second positioning mold 2 includes a second positioning upper mold 201 and a second positioning lower mold 202 abutting against each other. The rounding mold 4 includes an upper rounding mold 401 and a lower rounding mold 402. In an embodiment, the first positioning upper mold 101, the second positioning upper mold 201 and the upper round mold 401 can be connected to an upper beam of a swelling molding machine, and the first positioning lower mold 102, the second positioning lower mold 202 and the lower round mold 402 are connected to a lower beam of the swelling molding machine, so as to improve work efficiency. It should be noted here that the swelling molding is familiar to those skilled in the art and will not be described herein.

In order to facilitate the communication with the first cavity 12, the first sealing ring 5 is connected to a first oil delivery pipe 9, and the first oil delivery pipe 9 is communicated with the first cavity 12. During the strengthening process of the pipe 14, the first oil pipe 9 can conveniently transport the hydraulic oil into the first cavity 12 or lead out the hydraulic oil in the first cavity 12. Similarly, the third sealing ring 7 is connected to a second oil delivery pipe 10, and the second oil delivery pipe 10 is communicated with the second cavity 13. The second oil delivery pipe 10 can transport the hydraulic oil into the second cavity 13. The second sealing ring 6 is connected to the at least one connecting rod 11, and the at least connecting rod 11 passes through the third sealing ring 7 and extends out of the second cavity 13. The at least one connecting rod 11 is configured to easily push and position the second sealing ring 6. In an embodiment, a thickness of the first sealing ring 5 is the same with a height of the first positioning mold 1, and the first sealing ring 5 is arranged directly opposite to the first positioning mold 1. A thickness of the second sealing ring 6 is the same with a height of the second positioning mold 2, and the second sealing ring 6 is arranged directly opposite to the second positioning mold 2. An end surface of the third sealing ring 7 close to the second sealing ring 6 is level with an end surface of the rounding mold 4 away from the second positioning mold 2, that is, in the accompanying drawings, a left end surface of the third sealing ring 7 is level with a right end surface of the rounding mold 4.

In some embodiments, the first sealing ring 5, the second sealing ring 6, the first oil delivery pipe 9 and the second oil delivery pipe 10 are coaxially arranged. The number of the at least one connecting rod 11 is two, and the two connecting rods 11 are symmetrically arranged on both sides of the second oil delivery pipe 10, improving the force uniformity of the second sealing ring 6. The first oil delivery pipe 9 is in threaded connection with the first sealing ring 5; the second oil delivery pipe 10 is in threaded connection with the third sealing ring 7; and the connecting rod 11 is in threaded connection with the second sealing ring 6. The threaded connection is tight and easy to disassemble and assemble.

The present disclosure further provides a method for strengthening a straight pipe. The at least two split molds 3 are adjusted to position the pipe 14, such that a gap is provided between an inner wall of the split molds 3 and the pipe 14. The pipe 14 is inserted into the first through hole and the second through hole. The first sealing ring 5 and the second sealing ring 6 are arranged in the inner cavity of the pipe 14. Hydraulic oil is injected into the first cavity 12 to press the inner wall of the pipe 14 to expand the pipe 14, so as to perform an expanding deformation. When the hydraulic oil in the pipe 14 is unloaded, the at least two split molds 3 move towards the axis of the first positioning mold 1 the axis of the first positioning mold 1 until adjacent two split molds abut against each other, so as to perform a reducing deformation. After multiple cycles of expanding and reducing deformations, the pipe 14 is transported forwards into the third through hole of the rounding mold 4, and hydraulic oil is injected into the second cavity 13 to press the inner wall of the pipe 14 to expand the pipe 14 to perform a rounding operation. The above operations are repeated until the pipe 14 is totally strengthened.

In some embodiments, the pipe 14 is positioned such that a minimum gap between the at least two split molds 3 and the pipe 14 is adjusted to 5 mm, and a pressure of the hydraulic oil injected into the first cavity 12 is 6.5 MPa. An expansion height of the pipe 14 is 5 mm. During the reducing deformation, a feed distance of the at least two split molds 3 towards the axis of the first positioning mold 1 is 5 mm, and a pressure of the hydraulic oil injected into the second cavity 13 is 6 MPa. In addition, a height of the split mold 3 is $L_1$=(0.50-1.0)D; a height of the rounding mold 4 is $L_2$=(1.05-1.10)$L_1$; an expansion height and a reducing depth is h=(0.05-0.10)D; in the equations, D is an initial diameter of the pipe 14.

The method of the disclosure will be further described with reference to the strengthening treatment of the pipe 14.

A thin-walled stainless steel straight pipe 14 with a diameter of 100 mm and a thickness of 1 mm is repeatedly reduced and expanded to strengthen. The first positioning upper mold 101, the first positioning lower mold 102, the second positioning upper mold 201, the second positioning lower mold 202, an upper rounding mold 401 and a lower rounding mold 402 are connected to a swelling molding machine, respectively. A plurality of split molds 3 are connected to a hydraulic cylinder through push rods 8. The height $L_1$ of the split molds 3 is 60 mm, and the height $L_2$ of the rounding mold 4 is 65 mm. A seal assembly is arranged in the pipe 14, the connecting rod 11 pushes the second sealing ring 6 to be directly opposite to the second positioning mold 2. The first cavity 12 is injected with the hydraulic oil of 6.5 MPa by means of the first oil delivery pipe 9, and the hydraulic oil presses an inner wall of the pipe 14 to expand with the expansion height of 5 mm, so as to perform an expanding deformation. The hydraulic oil in the first cavity 12 is unloaded by means of the first oil delivery pipe 9. The plurality of split molds 3 driven by the hydraulic cylinder move towards the axis of the pipe 14 to until adjacent two split molds abut against each other and form a ring. The distance of the plurality split molds 3 towards the axis of the first positioning mold 1 is 5 mm, so as to perform a reducing deformation. After five cycles of expanding and reducing deformations, the pipe 14 moves forwards to a step length, and then the second cavity 13 is filled the hydraulic oil of 6.0 MPa by means of a second oil delivery pipe 10. The hydraulic oil presses the inner wall of the pipe 14 to expand, so as to perform a rounding operation. Then another part of the pipe 14 undergoes the strengthening treatment. After the strengthening treatment, the strength of the pipe 14 has been increased from 265 MPa to 320 MPa; a flexural rigidity of the pipe 14 has been increased from 500 N/mm to 720 N/mm; and hardness of the pipe 14 has been increased from 196 HV to 245 HV. The stiffness, strength and hardness of the pipe 14 have been largely improved.

The embodiments provided herein are merely illustrative, and are not intended to limit this disclosure. Modifications and variations made by those skilled in the art without departing from the spirit of the present disclosure should still fall within the scope of the disclosure.

What is claimed is:

1. A device for strengthening a straight pipe, comprising:
a first positioning mold;
a second positioning mold;
at least two split molds;
a rounding mold; and
a sealing assembly;
wherein the first positioning mold and the second positioning mold are coaxially arranged and are respectively provided with a first through hole and a second through hole configured to allow a pipe to pass through; the at least two split molds are arranged between the first positioning mold and the second positioning mold and slidable with respect to the first positioning mold and the second positioning mold along a direction which is perpendicular to an axis of the first positioning mold; adjacent split molds of the at least two split molds abut against each other to form a ring; a side of each of the at least two split molds facing the axis of the first positioning mold has a convex surface; a minimum inner diameter of the ring formed by the at least two split molds is smaller than an inner diameter of the first positioning mold; the rounding mold is arranged downstream of the at least two split molds along a transportation direction of the pipe, and abuts against the second positioning mold; the rounding mold is provided with a third through hole configured to allow the pipe to pass through; an inner diameter of the rounding mold matches with an outer diameter of the pipe; the sealing assembly comprises a first sealing ring, a second sealing ring and a third sealing ring; the first sealing ring, the second sealing ring and the third sealing ring are able to enter an inner cavity of the pipe; the first sealing ring and the second sealing ring form a first cavity with an inner wall of the pipe; the second sealing ring and the third sealing ring form a second cavity with the inner wall of the pipe; and the first cavity is communicated with an external environment, and the second cavity is communicated with the external environment.

2. The device of claim 1, wherein the at least two split mold are connected to a push rod; an axis of the push rod is perpendicular to the axis of the first positioning mold, and intersects the axis of the first positioning mold; the push rod is connected to a hydraulic cylinder; and the hydraulic cylinder is configured to drive the push rod to reciprocate.

3. The device of claim 2, wherein the number of the at least two split molds is six, and the six split molds are evenly arranged in a circumferential direction.

4. The device of claim 1, wherein the first positioning mold, the second positioning mold and the rounding mold all have a split structure; the first positioning mold comprises a first positioning upper mold and a first positioning lower mold abutting against each other; the second positioning mold comprises a second positioning upper mold and a second positioning lower mold abutting against each other; and the rounding mold comprises an upper rounding mold and a lower rounding mold.

5. The device of claim 1, wherein the first sealing ring is connected to a first oil delivery pipe; the first oil delivery pipe is communicated with the first cavity; the third sealing ring is connected to a second oil delivery pipe; the second oil pipe is communicated with the second cavity; the second sealing ring is connected to at least one connecting rod; and the at least one connecting rod passes through the third sealing ring and extends out of the second cavity.

6. The device of claim 5, wherein the first sealing ring, the second sealing ring, the first oil delivery pipe and the second oil delivery pipe are coaxially arranged; the number of the at least one connecting rod is two, and the two connecting rods are provided symmetrically on both sides of the second oil delivery pipe; the first oil delivery pipe is in threaded connection with the first sealing ring; the second oil delivery pipe is in threaded connection with the third sealing ring; and the two connecting rods are in threaded connection with the second sealing ring.

7. A method for strengthening a straight pipe using the device of claim 1, comprising:
adjusting the at least two split molds to position a pipe such that a gap is provided between an inner wall of each of the at least two split molds and the pipe;
inserting the pipe into the first through hole and the second through hole;
arranging the first sealing ring and the second sealing ring in the inner cavity of the pipe;
injecting hydraulic oil into the first cavity to press the inner wall of the pipe to expand the pipe, so as to perform an expanding deformation;
unloading the hydraulic oil in the pipe;
moving the at least two split molds towards the axis of the first positioning mold until adjacent two split molds abut against each other, so as to perform a reducing deformation;
repeating steps of from the expanding deformation to the reducing deformation multiple times;
transporting the pipe forwards into the third through hole; and
injecting hydraulic oil to the second cavity to press the inner wall of the pipe to expand the pipe to perform a rounding operation.

8. The method of claim 7, wherein the steps of from the expanding deformation to the reducing deformation are repeated five times to transport the pipe to the rounding mold for rounding.

* * * * *